United States Patent [19]

Kinberg

[11] 4,418,908

[45] Dec. 6, 1983

[54] ACTION GAME

[76] Inventor: Benjamin Kinberg, 425 Riverside Dr., New York, N.Y. 10025

[21] Appl. No.: 377,709

[22] Filed: May 13, 1982

[51] Int. Cl.[3] ..... A63F 7/00; A63F 7/24; A63F 7/30

[52] U.S. Cl. ..... 273/1 GE; 273/108; 273/119 B; 273/315; 46/44

[58] Field of Search ..... 273/1 GE, 119 B, 85 H, 273/315, 108; 46/44

[56] References Cited

U.S. PATENT DOCUMENTS 2,919,135 12/1959 Marchionda ..... 273/119 B
3,884,471 5/1975 Maurer et al. ..... 273/315
4,042,243 8/1977 Hoel et al. ..... 273/119 B X
4,227,690 10/1980 Pitkanen ..... 273/1 GE

*Primary Examiner*—Paul E. Shapiro
*Attorney, Agent, or Firm*—Kontler, Grimes & Battersby

[57] ABSTRACT

An action game for two or more players has a plurality of player stations, always arranged in pairs. Each pair of player stations is associated with a tiltable rocker or perch on which a figure, such as a sitting duck, is placed. Each player station also has an air bulb; when punched (compressed) this bulb causes a plunger to be flung against the perch. The plunger activated by the faster of the players will hit the perch first, causing it to tilt in direction toward that player's bulb and to fling the figure off the perch in this direction. The player able to score the greatest number of hits within a given number of tries, or within a specified period, is the winner.

10 Claims, 3 Drawing Figures

ACTION GAME

BACKGROUND OF THE INVENTION

The present invention relates to a game.

More particularly, the invention relates to an action game.

Still more specifically, the invention relates to a multi-player action game.

Games are known in too numerous varieties to list within the framework of this application. No matter how constructed and/or played, all games have in common one overriding purpose: to entertain and amuse. Certain games also aim to educate the player or players, but even then the amusement aspect always remains foremost since it is desired to direct the player's attention to the entertaining aspects of the game without making the educational considerations too obvious (and thereby perhaps losing the player's interest).

A rough division of games might be made into more passive games and more active (player-participation) ones. The latter are "action" games, i.e. games in which more or less intensive player action takes place. The present invention is directed to a game of this latter type.

SUMMARY OF THE INVENTION

It is an object of the present invention to provide a novel, improved game.

A more particular object of the invention is to provide a novel action game.

A still more specific object is to provide a novel multi-player action game.

A concomitant object of the invention is to provide a relatively simple, but engrossing action game.

In keeping with the above objects, and with still others which will become apparent as the description proceeds, one aspect of the invention resides in an action game. Briefly stated, such a game may comprise a base; at least one set composed of at least two cooperating player stations on the base, each of the stations including a gas-containing elastically deformable volume-changing receptacle, a tube sealingly connected with the receptacle and having an open end, and a plunger fluid-tightly received in and reciprocable lengthwise of the tube, the tubes of the station being axially aligned with one another and the open ends thereof being somewhat spaced from each other; at least one perch, including an element which is rockable about a pivot normal to the elongation of said tubes and includes a normally horizontal cross-member and an upright member depending therefrom and located intermediate the open ends, so that an impact on the upright member by one of the plungers which is propelled by gas expelled from a respective one of the receptacles, causes the element to rock about the pivot; and at least one figure adapted to rest on the perch and to be dislodged therefrom by rocking of the element in a direction towards whichever one of the plunger impacts the upright member first.

The novel features which are considered to be characteristic of the invention are set forth in particular in the appended claims. The improved device itself, however, together with its construction and mode of operation, as well as additional features and advantages thereof, will be best understood upon a perusal of the following detailed description of specific although purely examplary embodiments with reference to the accompanying drawing.

DESCRIPTION OF PREFERRED EMBODIMENTS

Figure 1:
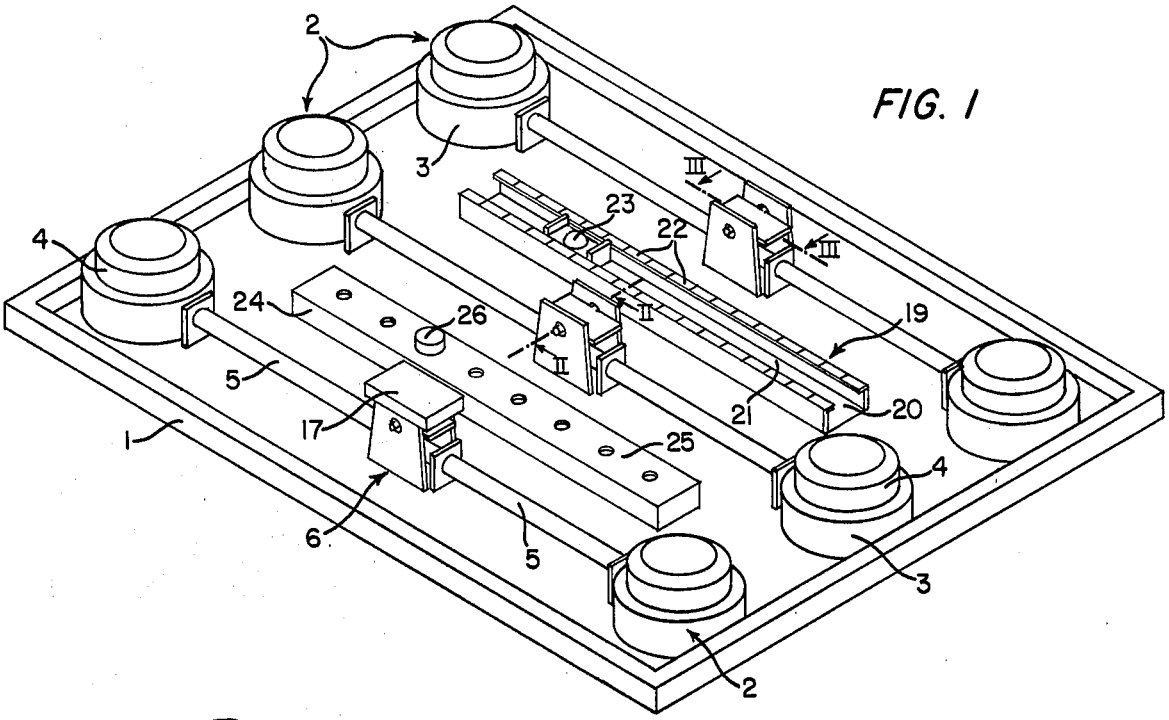
FIG. 1 is a top-perspective view, illustrating an action game in accordance with the present invention.
Figure 2:
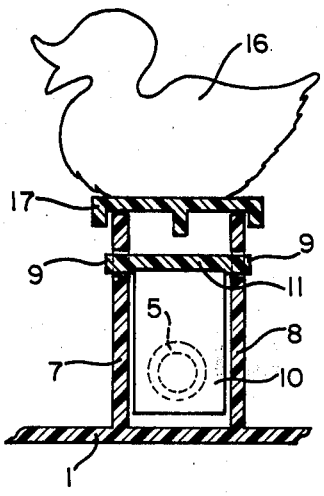
FIG. 2 is a sectional elevation, taken on line II—II of FIG. 1.
Figure 3:
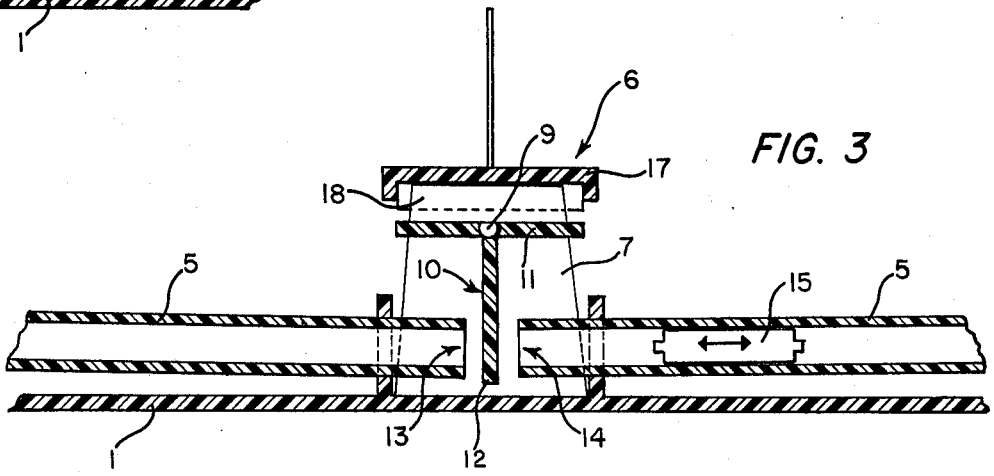
FIG. 3 is a side-elevational view, partly in a section taken on line III—III of FIG. 1.

The drawing shows, in its FIGS. 1–3 thereof, an exemplary embodiment of the inventive action game.

FIG. 1 illustrates a game base or board 1 on which a plurality (here six) of player stations are mounted. Each player station 2 comprises a bottom rim 3 in the open top of which a bulb 4 of elastomeric material (i.e. natural or synthetic plastic material) is either fluid-tightly received or with which it is of one part (e.g. made by blow-molding).

From each player station 2 a tube 5 (of synthetic plastic material, such as polyethylene, polystryene, polyvinyl or the like, and preferably but not necessarily transparent or translucent) leads out of the respective rim 3 and to a perch 6 located midway between two associated player stations 2, i.e. between those from which the tubes 5 lead to the perch 6.

The perches 6 each have two sidewalls 7, 8 extending parallel to the tubes 5 (compare FIGS. 2 and 3). Mounted on a pivot 9 in the open-topped space between each set of sidewalls 7, 8, is a T-shaped element 10 having an upper cross member 11 from which an upright member 12 depends. The element 10 thus is able to swing about the pivot 9. This freedom of swinging movement is, however, curtailed by the fact that the upright member 12 is located between the open ends 13, 14 (FIG. 3) of the associated tubes 5, i.e. of those tubes which cooperate jointly with a perch 6 that is common to them. The upright member 12 is spaced from both open ends 13, 14 by a distance which is relatively small, but which allows the entire T-shaped element 10 to swing about the pivot 9 in one and in the opposite direction.

Accommodated in each of the tubes 5 is a plunger 15 (see FIG. 3; but only one shown) which can reciprocate in the respective tube in the directions indicated by the double-headed arrow, i.e. lengthwise of the tube. On moving forwardly and reaching (in fact, just extending beyond) the open end 14, the plunger 15 will impact the upright member 12, thereby causing the element 10 to swing sharply about the pivot 9 in a direction towards the plunger 15 which has just struck it (except that the upright member 12 initially appears to be moving away from the plunger). This swing motion is, of course, checked as soon as the upright member 12 abuts against the open end of the other tube, i.e. here the open end 13.

The motion of the plunger 15 is imparted thereto by a player depressing the bulb 4 of his station 2 to which the tube 5 accommodating the plunger 15 is connected. This causes air to be expelled from the bulb 4 into the tube 5 behind plunger 15; since the plunger slides smoothly in its tube 5 but is fluid-tightly accommodated therein, expulsion of air from the bulb 4 into the tube 5 will impel the plunger 15 towards the respective open end 13 or 14. At the same time it creates a partial vacuum in the compressed bulb. The plunger 15 moves rapidly through its tube 5 and delivers a quick impact to the upright member 12. As soon as the player removes his finger from the bulb 4 so that the bulb can expand again, air is aspirated back into the bulb from the region of the tube 5 which is located between the plunger and the bulb; the result is that the plunger 15 is drawn out of tube 5 and wholly or partly back into the re-expanded bulb 4, so that it is now ready for the next playing episode. It should be noted that the player stations 2 are already known per se and that a more detailed description is therefore not deemed to be necessary.

The object of the game is to "shoot" ducks 16 or other game birds (FIG. 2). However, it is of course understood that figures of other game animals might be substituted or that even criminals hunted by lawmen might be "captured" or perhaps unpopular politicians might be "discharged" from office. Whatever the particular figure that is chosen, it has a base 17 (shown with a duck figure in FIG. 2 and by itself in FIGS. 1 and 3) which is dimensioned to fit onto the perch 6; which is to say, over and to rest upon the upper free edges of the walls 7, 8. Furthermore, the base 17 has a fin 18 which depends from it (this could of course have a shape other than a fin, e.g. in form of two or more projections or any suitable configuration) to, or almost to, the cross-member 11 of the perch 6 onto which the particular figure is placed.

It will be clear from the foregoing that if a player rapidly depresses one of the bulbs 4, he will thereby cause the plunger 15 in the tube 5 extending out from that particular bulb, to be propelled forwardly until its leading end emerges from the open tube end 13 or 14 and impacts the upright member 12 of the associated perch 6, thereby causing the element 10 to swing or tilt sharply about the pivot 9 and (via the resulting interaction between cross-member 11 and fin 18) to fling the figure 16 off the perch in the direction towards the player station whose bulb 4 was just depressed. Since the game according to the invention is a competitive one, involving a certain amount of skill and speed, there will always be at least two persons playing against each other. The winner of a particular playing incident (i.e. dislodging of a single figure 16) will be the person who most quickly depresses his bulb 4, causing the figure 16 to be flung off the perch 6 in direction towards this particular bulb.

The rings 3 and/or the bulbs 4 are color-coded (although some other method of differentiation could be employed instead). For example, the rings and/or bulbs at one end of the base 1 might be green, yellow and blue, respectively, and the colors of the rings and/or bulbs at the other end of the base 1 would then be matched thereto. In other words, the rings and/or bulbs of any two player stations 2 which cooperate with one and the same perch 6, will be of identical color.

To play the game, and assuming that there are two players involved, a decision must be made at the start of each playing episode as to which of the player stations 2 (e.g. green, yellow or blue) is to be used in the following episode. For this purpose a color selector 19 is provided, which is here mounted on (or of one piece with) the base 1 and configurated in form of an elongated track 20 having a longitudinally extending slot 21 which is flanked at one or both sides by surfaces subdivided into sections 22 which each have a color corresponding to one of the ring and/or bulb colors. Evidently, these colors need not be provided along the track 20 in a repetitive manner (e.g. green, yellow, then blue) but may be mixed up along the length of the track in any desired (or random) sequence. The opposite ends of track 20 are provided with suitable spring means (not shown), such as respective helical springs, rubber bands or the like. A selecting member, for example a bearing ball 23, is freely movable lengthwise of the track 20. The player whose turn it is to make the next color selection draws the ball 23 back against the spring means at one end of track 20; he then lets go so that the spring means will propel ball 23 along track 20. The color of the section 22 opposite which the ball comes to rest, is the color of the player station 2 to be used, i.e. of the two bulbs 4 to be punched. Whichever player manages to punch his bulb 4 first, wins the particular playing episode.

It goes without saying, of course, that the selector 19 could be totally different from the one illustrated (e.g. a spinning wheel type working with colors or numbers, or even an electronic type) and that it need not be located where the selector is shown in FIG. 1 but could be located elsewhere, for example be a separate entity that is placed somewhere completely off the base 1.

The winner of the game is the player winning the largest number of individual playing episodes. To keep track of this, a score-keeper may be provided in form of the illustrated bar 24 having a plurality of holes 25 into which appropriately colored pins, buttons or analogous elements 26 are insertable. Again, however, it is noted that the score-keeper may operate on any other suitable principle and also could be located elsewhere, e.g. entirely off the base 1.

Any and all parts of the game in FIGS. 1–3 may be blow-molded or otherwise produced from synthetic plastic materials, such as polystyrene and/or polyethylene, and/or vinyl and/or others. Many of the components (for example the base 1 and walls 7, 8 or the respective base 17 and figure 16, to name just two possibilities) may be produced of one piece with one another, thus increasing the structural sturdiness of the game, reducing assembly time and steps, and allowing manufacturing economies to be realized.

It should also be clear, as hereinbefore repeatedly mentioned, that the embodiment illustrated in FIGS. 1–3 is purely exemplary, for the purpose of describing the invention as required by law. Various structural changes may, however, clearly be made—including the use of a greater or smaller number of player stations—without thereby departing in any way from the gist of the invention.

Without further analysis, the foregoing will so fully reveal the gist of the present invention that others can, by applying current knowledge, readily adapt it for various applications without omitting features that, from the standpoint of prior art, fairly consitute essential characteristics of the generic and specific aspects of the inventive contribution to the art and, therefore, such adaptations should and indeed are intended to be comprehended within the meaning and scope of equivalence of the appended claims.

I claim:

1. An action game for two or more players, comprising a base;

at least one set composed of at least two cooperating player stations on said base, each of said stations including a gas-containing elastically deformable volume-changing receptacle, a tube sealingly connected with the receptacle and having an open end, and a plunger fluid-tightly received in and reciprocable lengthwise of the tube, the tubes of said stations being axially aligned with one another and the open ends thereof being somewhat spaced from each other;

at least one perch, including an element which is rockable about a pivot normal to the elongation of said tubes and including a normally horizontal cross-member and an upright member depending therefrom and located intermediate said open ends so that an impact upon said upright member by one of said plungers which is propelled by gas expelled from a respective one of said receptacles, causes said element to rock about said pivot; and at least one figure adapted to rest on said perch and to be dislodged therefrom by rocking of said element in a direction towards whichever one of said plungers impacts said upright member first.

2. An action game as defined in claim 1, comprising at least one additioal set, perch and figure each.

3. An action game as defined in claim 1, said element being substantially T-shaped and said cross-member being the cross-bar of the T.

4. An action game as defined in claim 1, wherein at least some of said base, set, perch and figure are of synthetic plastic material.

5. An action game as defined in claim 1, wherein at least some of said base, set, perch and figure are of synthetic plastic material and produced by blow-molding.

6. An action game as defined in claim 1, wherein said perch includes a pair of side walls extending parallel to the tubes at opposite sides thereof and having upper free edges, said figure including a base member shaped to rest on said upper free edges.

7. An action game as defined in claim 6, said upper free edges being spaced transversely from one another and vertically from said cross-member, and said base member including at least one contact portion projecting downwardly intermediate said upper free edges towards said cross-member, so as to follow the rocking movement of said element.

8. An action game as defined in claim 1, wherein said figure includes a base member shaped to rest on said perch, and an effigy mounted on said base member.

9. An action game as defined in claim 8, wherein said effigy is in the shape of an animal.

10. An action game as defined in claim 9, wherein said animal is a duck.

* * * * *